US011030950B2

(12) United States Patent
Kwon et al.

(10) Patent No.: US 11,030,950 B2
(45) **Date of Patent: *Jun. 8, 2021**

(54) ORGANIC LIGHT-EMITTING DISPLAY HAVING PIXEL WITH SENSING TRANSISTOR

(71) Applicant: SAMSUNG DISPLAY CO., LTD., Yongin-si (KR)

(72) Inventors: Oh Jo Kwon, Suwon-si (KR); Joo Hyung Lee, Gwacheon-si (KR); Kyung Youl Min, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/586,534

(22) Filed: Sep. 27, 2019

(65) Prior Publication Data

US 2020/0027398 A1 Jan. 23, 2020

Related U.S. Application Data

(63) Continuation of application No. 16/105,862, filed on Aug. 20, 2018, now Pat. No. 10,438,533, which is a (Continued)

(30) Foreign Application Priority Data

Dec. 1, 2014 (KR) ..... 10-2014-0169775

(51) Int. Cl.
*G09G 3/3233* (2016.01)
*G09G 3/3275* (2016.01)
*G09G 3/3291* (2016.01)

(52) U.S. Cl.
CPC ..... *G09G 3/3233* (2013.01); *G09G 3/3275* (2013.01); *G09G 3/3291* (2013.01); (Continued)

(58) Field of Classification Search
CPC ..... G09G 3/3233; G09G 3/3275; G09G 2300/0861; G09G 2300/0819; (Continued)

(56) References Cited

U.S. PATENT DOCUMENTS 8,115,707 B2 2/2012 Nathan et al.
8,269,803 B2 9/2012 Yoo et al.
(Continued)

FOREIGN PATENT DOCUMENTS

KR 10-2011-0032937 A 3/2011
KR 10-2011-0057534 A 6/2011
(Continued)

OTHER PUBLICATIONS

Chaji, G.R. et al., Abstract of "A Current-Mode Comparator for Digital Calibration of Amorphous Silicon AMOLED Displays", Circuits and Systems II: Express Briefs, 2008, 1 Page, vol. 55, Issue 7, IEEE.

*Primary Examiner* — Yaron Cohen
(74) *Attorney, Agent, or Firm* — Lewis Roca Rothgerber Christie LLP

(57) ABSTRACT

An organic light-emitting display includes: a display panel including first and second pixels, each having an organic light-emitting diode; and a data driver including a first operational amplifier having a non-inverting terminal coupled to a reference voltage terminal and an inverting terminal coupled to the first pixel, and a second operational amplifier having a non-inverting terminal coupled to the reference voltage terminal and an inverting terminal coupled to the second pixel. The first pixel includes a sensing (Continued)

transistor, a first driving transistor, and a first switch transistor. The second pixel includes a second driving transistor and a second switch transistor.

21 Claims, 11 Drawing Sheets

Related U.S. Application Data continuation of application No. 14/690,303, filed on Apr. 17, 2015, now Pat. No. 10,056,032.

(52) U.S. Cl.
CPC ..... *G09G 2300/0819* (2013.01); *G09G 2300/0842* (2013.01); *G09G 2300/0861* (2013.01); *G09G 2310/027* (2013.01); *G09G 2310/0251* (2013.01); *G09G 2310/0291* (2013.01); *G09G 2310/0297* (2013.01); *G09G 2320/029* (2013.01); *G09G 2320/0233* (2013.01); *G09G 2320/0257* (2013.01); *G09G 2320/045* (2013.01); *G09G 2330/12* (2013.01)

(58) Field of Classification Search
CPC ... G09G 2310/0297; G09G 2310/0291; G09G 2320/045; G09G 2320/0233; G09G 2310/027; G09G 2320/0257; G09G 2330/12; G09G 2300/0842; G09G 2310/0251; G09G 3/3291; G09G 2320/029
See application file for complete search history.

(56) References Cited

U.S. PATENT DOCUMENTS

| | | | | |
|---|---|---|---|---|
| 8,558,825 | B2 | 10/2013 | Bae et al. | |
| 2006/0017680 | A1 | 1/2006 | Chen et al. | |
| 2007/0177043 | A1 | 8/2007 | Kok | |
| 2008/0191976 | A1 | 8/2008 | Nathan et al. | |
| 2010/0079433 | A1 | 4/2010 | Ishiguro et al. | |
| 2011/0254871 | A1* | 10/2011 | Yoo | G09G 3/3233 345/690 |
| 2012/0019569 | A1 | 1/2012 | Byun | |

FOREIGN PATENT DOCUMENTS

| | | | |
|---|---|---|---|
| KR | 10-1065405 | B1 | 9/2011 |
| KR | 10-2012-0012597 | A | 2/2012 |
| KR | 10-2013-0024744 | A | 3/2013 |
| KR | 10-2014-0013146 | A | 2/2014 |

* cited by examiner

ORGANIC LIGHT-EMITTING DISPLAY HAVING PIXEL WITH SENSING TRANSISTOR

CROSS-REFERENCE TO RELATED APPLICATION

This application is a continuation of U.S. patent application Ser. No. 16/105,862, filed Aug. 20, 2018, which is a continuation of U.S. patent application Ser. No. 14/690,303, filed Apr. 17, 2015, now U.S. Pat. No. 10,056,032, which claims priority to and the benefit of Korean Patent Application No. 10-2014-0169775, filed Dec. 1, 2014, the entire content of all of which is incorporated herein by reference.

BACKGROUND

1. Field

The present invention relates to an organic light-emitting display.

2. Description of Related Art

An organic light-emitting display, which is drawing attention as a next-generation display, displays an image using an organic light-emitting diode which emits light by recombination of electrons and holes. The organic light-emitting display has features of high response speed, high luminance, a wide viewing angle, and low power consumption.

The organic light-emitting display controls the amount of current provided to the organic light-emitting diode using a driving transistor included in each pixel and generates light having luminance (e.g., specific luminance) according to the amount of current provided to the organic light-emitting diode.

The organic light-emitting diode is degraded in proportion to the duration of use, thereby reducing display luminance. In particular, there occurs a luminance difference between pixels due to a difference in characteristics such as a threshold voltage (Vth) of the driving transistor and the degradation of the organic light-emitting diode. If the luminance imbalance worsens, an image sticking phenomenon may occur, resulting in reduced image quality.

SUMMARY

Aspects of the present invention provide an organic light-emitting display which can accurately measure an electric current of each pixel using a simple structure in order to compensate for a luminance difference between the pixels.

However, aspects of the present invention are not restricted to those set forth herein. The above and other aspects of the present invention will become more apparent to one of ordinary skill in the art to which the present invention pertains by referencing the detailed description of embodiments of the present invention given below.

According to an aspect of the present invention, an organic light-emitting display includes: a display panel including first and second pixels, each having an organic light-emitting diode; and a data driver including a first operational amplifier having a non-inverting terminal coupled to a reference voltage terminal and an inverting terminal coupled to the first pixel, and a second operational amplifier having a non-inverting terminal coupled to the reference voltage terminal and an inverting terminal coupled to the second pixel. The first pixel includes a sensing transistor which has a first electrode coupled to the data driver and a second electrode coupled to the organic light-emitting diode of the first pixel, a first driving transistor which has a first electrode coupled to a first power supply terminal and a second electrode coupled to the second electrode of the sensing transistor, and a first switch transistor which has a first electrode coupled to the data driver and a second electrode coupled to a gate electrode of the first driving transistor. The second pixel includes a second driving transistor which has a first electrode coupled to the first power supply terminal and a second electrode coupled to the organic light-emitting diode of the second pixel, and a second switch transistor which has a first electrode coupled to the data driver and a second electrode coupled to a gate electrode of the second driving transistor.

The non-inverting terminal of each of the first and second operational amplifiers may be configured to receive from the reference voltage terminal a reference voltage at a level equal to or higher than that of a threshold voltage of the organic light-emitting diode included in the first pixel.

The data driver may include: a data provider which is coupled to the display panel by a plurality of data lines; a plurality of current measurers, each including a first measurement circuit having the first operational amplifier and a second measurement circuit having the second operational amplifier; and a data processor having an analog-to-digital converter (ADC) which is configured to convert output signals of the current measurers into digital values.

The data driver may further include a multiplexer between the current measurers and the display panel.

The first measurement circuit may further include a first feedback capacitor which is coupled between the inverting terminal of the first operational amplifier and an output terminal of the first operational amplifier, a first feedback switch which is coupled in parallel to the feedback capacitor between the inverting terminal of the first operational amplifier and the output terminal of the first operational amplifier, and a first switch which is coupled between the first pixel and the inverting terminal of the first operational amplifier. The second measurement circuit may further include a second feedback capacitor which is coupled between the inverting terminal of the second operational amplifier and an output terminal of the second operational amplifier, a second feedback switch which is coupled in parallel to the feedback capacitor between the inverting terminal of the second operational amplifier and the output terminal of the second operational amplifier, and a second switch which is coupled between the second pixel and the inverting terminal of the second operational amplifier.

Each of the current measurers may further include a correlated double sampler (CDS) which is coupled to an output terminal of each of the first and second operational amplifiers.

The data provider may include: a plurality of digital-to-analog converters (DACs) which are coupled to the display panel by the data lines; and a plurality of third switches which are coupled between the DACs and the data lines.

The organic light-emitting display may further include a power provider which is coupled to the first power supply terminal by a power supply line, and each of the current measurers may further include a first initialization switch which is coupled between each of the first and second pixels and the power provider, and a second initialization switch which is coupled between each of the first and second pixels and the power provider.

The organic light-emitting display may further include a power switch which is configured to couple a power line coupled to the first electrode of each of the first and second driving transistors to the first power supply terminal or a second power supply terminal, the second power supply terminal having a lower electric potential than the first power supply terminal.

According to another aspect of the present invention, an organic light-emitting display includes: a data driver having a current measurer which is coupled to a plurality of data lines; and a display panel having a plurality of first pixels which are coupled to the current measurer by the data lines and a second pixel which is coupled to the current measurer by at least one of the data lines. Each of the first pixels includes a sensing transistor which has a first electrode coupled to the current measurer and a second electrode coupled to an organic light-emitting diode, a first driving transistor which has a first electrode coupled to a first power supply terminal and a second electrode coupled to the second electrode of the sensing transistor, and a first switch transistor which has a first electrode coupled to the current measurer and a second electrode coupled to a gate electrode of the first driving transistor. The second pixel includes a second driving transistor which has a first electrode coupled to the first power supply terminal and a second electrode coupled to an organic light-emitting diode, and a second switch transistor which has a first electrode coupled to the current measurer and a second electrode coupled to a gate electrode of the second driving transistor.

The current measurer may include: a first measurement circuit having a first operational amplifier which has a non-inverting terminal coupled to a reference voltage terminal and an inverting terminal coupled to each of the first pixels, a first feedback capacitor which is coupled between the inverting terminal of the first operational amplifier and an output terminal of the first operational amplifier, a first feedback switch which is coupled in parallel to the feedback capacitor between the inverting terminal of the first operational amplifier and the output terminal of the first operational amplifier, and a first switch which is coupled between each of the first pixels and the inverting terminal of the first operational amplifier; a second measurement circuit having a second operational amplifier which has a non-inverting terminal coupled to the reference voltage terminal and an inverting terminal coupled to the second pixel, a second feedback capacitor which is coupled between the inverting terminal of the second operational amplifier and an output terminal of the second operational amplifier, a second feedback switch which is coupled in parallel to the feedback capacitor between the inverting terminal of the second operational amplifier and the output terminal of the second operational amplifier, and a second switch which is coupled between the second pixel and the inverting terminal of the second operational amplifier; and a correlated double sampler (CDS) which is coupled to the output terminal of each of the first and second operational amplifiers.

The non-inverting terminal of each of the first and second operational amplifiers may receive from the reference voltage terminal a reference voltage at a level equal to or higher than that of a threshold voltage of the organic light-emitting diode included in each of the first pixels.

The data driver may include: a data provider including a plurality of DACs which are coupled to the display panel by the data lines, and a plurality of third switches which are coupled between the DACs and the data lines; and a data processor having an ADC which is configured to convert an output signal of the current measurer into a digital value.

The data driver may further include a multiplexer between the current measurer and the display panel.

The organic light-emitting display may further include a power provider which is coupled to the first power supply terminal by a power supply line, and the current measurer may further include a first initialization switch which is coupled between each of the first and second pixels and the power provider, and a second initialization switch which is coupled between each of the first and second pixels and the power provider.

According to another aspect of the present invention, an organic light-emitting display includes: a data driver having a current measurer which is coupled to a plurality of data lines; and a display panel having first and second pixels which are configured to receive a reference voltage from the current measurer through the data lines in a reference voltage applying period. The first pixel includes a sensing transistor which is configured to apply the reference voltage to an anode of an organic light-emitting diode through a switching operation, and the current measurer is configured to measure an electric current flowing through the organic light-emitting diode of the first pixel and an electric current flowing through a data line coupled to the second pixel in a measurement period following the reference voltage applying period.

The current measurer may include: a first measurement circuit having a first operational amplifier which has a non-inverting terminal configured to receive the reference voltage and an inverting terminal coupled to the first pixel, a first feedback capacitor which is coupled between the inverting terminal of the first operational amplifier and an output terminal of the first operational amplifier, a first feedback switch which is coupled in parallel to the feedback capacitor between the inverting terminal of the first operational amplifier and the output terminal of the first operational amplifier, and a first switch which is coupled between the first pixel and the inverting terminal of the first operational amplifier; a second measurement circuit having a second operational amplifier which has a non-inverting terminal configured to receive the reference voltage and an inverting terminal coupled to the second pixel, a second feedback capacitor which is coupled between the inverting terminal of the second operational amplifier and an output terminal of the second operational amplifier, a second feedback switch which is coupled in parallel to the feedback capacitor between the inverting terminal of the second operational amplifier and the output terminal of the second operational amplifier, and a second switch which is coupled between the second pixel and the inverting terminal of the second operational amplifier; and a correlated double sampler (CDS) which is configured to calculate a potential difference between output signals of the first and second measurement circuits.

The data driver may further include a data processor having an analog-to-digital converter (ADC) which is configured to convert an output signal of the CDS into a data signal.

The first pixel may further include a first driving transistor which has a first electrode coupled to a first power supply terminal and a second electrode coupled to a second electrode of the sensing transistor, a first switch transistor which has a first electrode coupled to the current measurer and a second electrode coupled to a gate electrode of the first driving transistor, and a first capacitor which is coupled between the second electrode of the first switch transistor and the first electrode of the first driving transistor. The second pixel may further include a second driving transistor which has a first electrode coupled to the first power supply terminal and a second electrode coupled to an organic light-emitting diode, a second switch transistor which has a first electrode coupled to the current measurer and a second electrode coupled to a gate electrode of the second driving transistor, and a second capacitor which is coupled between the second electrode of the second switch transistor and the first electrode of the second driving transistor.

The organic light-emitting display may further include a power provider which is configured to apply a first initialization voltage to the data lines in a first initialization period and to apply a second initialization voltage to the first and second capacitors in a second initialization period following the first initialization period.

BRIEF DESCRIPTION OF THE DRAWINGS

The above and other aspects and features of the present invention will become more apparent by describing in detail example embodiments thereof with reference to the attached drawings, in which.

DETAILED DESCRIPTION

Figure 1:
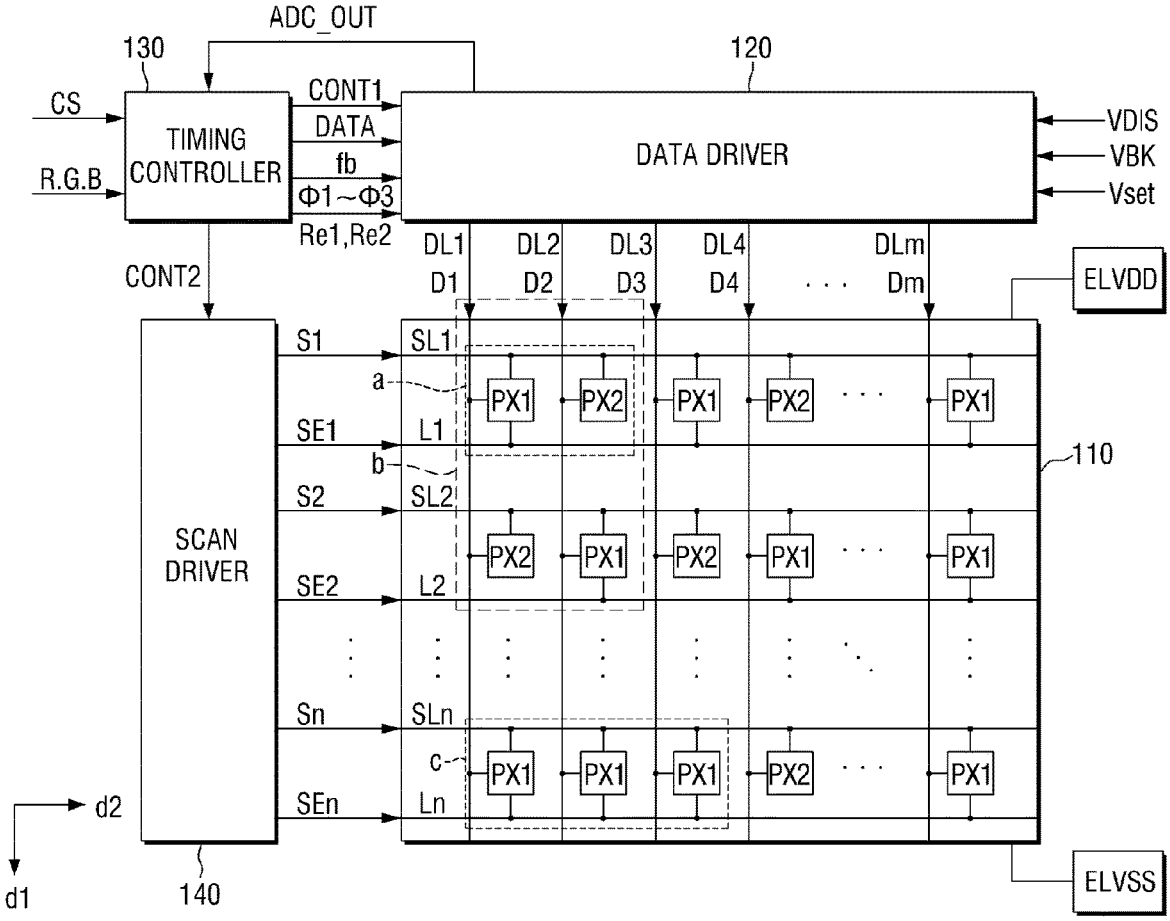
FIG. 1 is a block diagram of an organic light-emitting display according to an embodiment of the present invention.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Embodiments may be described herein with reference to cross-section illustrations that are schematic illustrations of example embodiments (and intermediate structures). As such, variations from the shapes of the illustrations as a result, for example, of manufacturing techniques and/or tolerances, are to be expected. Thus, these embodiments should not be construed as limited to the particular shapes of regions illustrated herein but are to include deviations in shapes that result, for example, from manufacturing. For example, an implanted region illustrated as a rectangle may have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

The timing controller, data driver, scan driver and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on a same substrate as the relevant devices or components. Further, the various components of these devices may be a process or thread, running on one or more processors, in one or more computing devices, executing computer program instructions and interacting with other system components for performing the various functionalities described herein. The computer program instructions may be stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirt and scope of the exemplary embodiments of the present invention.

Hereinafter, embodiments of the present invention will be described with reference to the accompanying drawings.

FIG. 1 is a block diagram of an organic light-emitting display according to an embodiment of the present invention.

Referring to FIG. 1, the organic light-emitting display according to the current embodiment may include a display panel 110, a data driver 120, a timing controller 130, a scan driver 140, and a power providing unit (or power provider).

The display panel 110 may be an area in which an image is displayed. The display panel 110 may include a plurality of data lines DL1 through DLm (where m is a natural number greater than one), a plurality of scan lines SL1 through SLn (where n is a natural number greater than one) crossing the data lines DL1 through DLm, and a plurality of sensing lines L1 through Ln (where n is a natural number greater than one) crossing the data lines DL1 through DLm. In addition, the display panel 110 may include a plurality of pixels disposed at crossing regions of the data lines DL1 through DLm and the scan lines SL1 through SLn. The pixels may include first and second pixels PX1 and PX2, each including an organic light-emitting diode OLED. The pixels including the first and second pixels PX1 and PX2 will hereinafter be indicated by reference character 'PX' to describe common parts of the first and second pixels PX1 and PX2. The data lines DL1 through DLm, the scan lines SL1 through SLn, the sensing lines L1 through Ln, and the pixels PX may be disposed on one substrate. The data lines DL1 through DLm, the scan lines SL1 through SLn, and the sensing lines L1 through Ln may be insulated from one another. The data lines DL1 through DLm may extend along a first direction d1, and the scan lines SL1 through SLn and the sensing lines L1 through Ln may extend along a second direction d2 crossing (e.g., intersecting) the first direction d1. In FIG. 1, the first direction d1 may be a column direction, and the second direction d2 may be a row direction.

The pixels PX may be arranged in a matrix. Of the pixels PX, each of the first pixels PX1 may be connected to one of the data lines DL1 through DLm, one of the scan lines SL1 through SLn, and one of the sensing lines L1 through Ln. Of the pixels PX, each of the second pixels PX2 may be connected to one of the data lines DL1 through DLm and one of the scan lines SL1 through SLn. That is, the second pixels PX2 may not be connected to the sensing lines L1 through Ln. Each of the pixels PX may receive a scan signal (one of S1 through Sn) through a connected scan line (one of SL1 through SLn) and receive a data signal (one of D1 through Dm) through a data line (one of DL1 through DLm). In addition, each of the first pixels PX may receive a sensing signal (one of SE1 through SEn) from the scan driver 140 through a connected sensing line (one of L1 through Ln). Each of the pixels PX may be connected to a first power supply terminal ELVDD by a first power supply line and may be connected to a second power supply terminal ELVSS by a second power supply line. Here, each of the pixels PX may control the amount of current flowing from the first power supply terminal ELVDD to the second power supply terminal ELVSS according to a data signal (one of D1 through Dm) received from a data line (one of DL1 through DLm).

The data driver 120 may be connected to the display panel 110 by the data lines DL1 through DLm. The data driver 120 may provide the data signals D1 through Dm through the data lines DL1 through DLm under the control of the timing controller 130. For example, the data driver 120 may provide a data signal (one of D1 through Dm) to a pixel PX selected according to a scan signal (one of S1 through Sn).

Each pixel PX of the display panel 110 may be turned on by a scan signal (one of S1 through Sn) at a low level and may display an image by emitting light according to a data signal (one of D1 through Dm) received from the data driver 120. The data driver 120 may include a plurality of current measurement units (or current measurers) 121 (see FIG. 6), a data processing unit 122 (or data processor) (see FIG. 6), a data provider 123 (see FIG. 6), and a first multiplexer 124 (see FIG. 6), which will be described later with reference to FIG. 6.

The timing controller 130 may receive a control signal CS and an image signal R, G, B from an external system. The control signal CS may include a vertical synchronization signal Vsync and a horizontal synchronization signal Hsync. The image signal R, G, B includes luminance information of the pixels PX. Luminance may have 1024, 256 or 64 gray levels. The timing controller 130 may generate image data DATA by dividing the image signal R, G, B on a frame-by-frame basis according to the vertical synchronization signal Vsync and dividing the image signal R, G, B on a scan line-by-scan line basis according to the horizontal synchronization signal Hsync. The timing controller 130 may provide control signals CONT1 and CONT2 respectively to the data driver 120 and the scan driver 140 in response to the control signal CS and the image signal R, G, B. The timing controller 130 may provide the image data DATA to the data driver 120 together with the control signal CONT1, and the data driver 120 may generate the data signals D1 through Dm by sampling and holding the input image data DATA and converting the image data DATA into analog voltages according to the control signal CONT1. Then, the data driver 120 may transmit the data signals D1 through Dm to the pixels PX through the data lines DL1 through DLm. The timing controller 130 may provide the data driver 120 with a feedback control signal fb for controlling a switching operation of a feedback switch SW_fb, first through third control signals ϕ1 through ϕ3 for controlling switching operations of first through third switches SW1 through SW3, and first and second initialization control signals Re1 and Re2 for controlling switching operations of first and second initialization switches SW_RE1 and SW_RE2. This will be described later with reference to FIGS. 7 and 8.

The scan driver 140 may be connected to the display panel 110 by the scan lines SL1 through SLn and the sensing lines L1 through Ln. The scan driver 140 may sequentially transmit the scan signals S1 through Sn to the scan lines SL1 through SLn according to the control signal CONT2 received from the timing controller 130. In addition, the scan driver 140 may provide sensing signals SE1 through SEn to pixels PX, whose electric currents may be measured during a sensing period, through the sensing lines L1 through Ln. In the present specification, a case where the scan driver 140 provides the sensing signals SE1 through SEn to the pixels PX is described as an example. However, the present invention is not limited to this case, and the sensing signals SE1 through SEn can also be provided to the pixels PX through a separate integrated circuit (IC) and the sensing lines L1 through Ln connected to the IC. To this end, the scan driver 140 may include a scan signal providing unit (or a scan signal provider) which is connected to gate electrodes of first and second switch transistors MS_1 and MS_2 (see FIG. 2) by one of the scan lines SL1 through SLn and a sensing signal providing unit (or a sensing signal provider) which is connected to a gate electrode of a sensing transistor MS_3 (see FIG. 2) by one of the sensing lines L1 through Ln. One of the scan signal providing unit and the sensing signal providing unit may be selected by a switching operation, and the timing controller 130 may control the switching operation according to the control signal CONT2.

The power providing unit may provide driving voltages to the pixels PX according to a control signal received from the timing controller 130. A voltage provided by the first power supply terminal ELVDD may be at a high level, and a voltage provided by the second power supply terminal ELVSS may be at a low level. The first and second power supply terminals ELVDD and ELVSS may provide driving voltages for the operation of the pixels PX. The voltage provided by the first power supply terminal ELVDD will hereinafter be indicated by reference character ELVDD, and the voltage provided by the second power supply terminal ELVSS will be indicated by reference character ELVSS. The power providing unit may provide a reference voltage Vset as well as first and second initialization voltages VDIS and VBK to the data driver 120. The reference voltage Vset provided by the power providing unit may be applied to each of non-inverting input terminals (+) of first and second operational amplifiers OP_amp_1 and OP_amp_2 (see FIG. 7). The first and second initialization voltages VDIS and VBK provided by the power providing unit may be applied to the data lines DL1 through DLm by the switching operations of the first and second initialization switches SW_RE1 and SW_RE2 (see FIG. 7).

Figure 2:
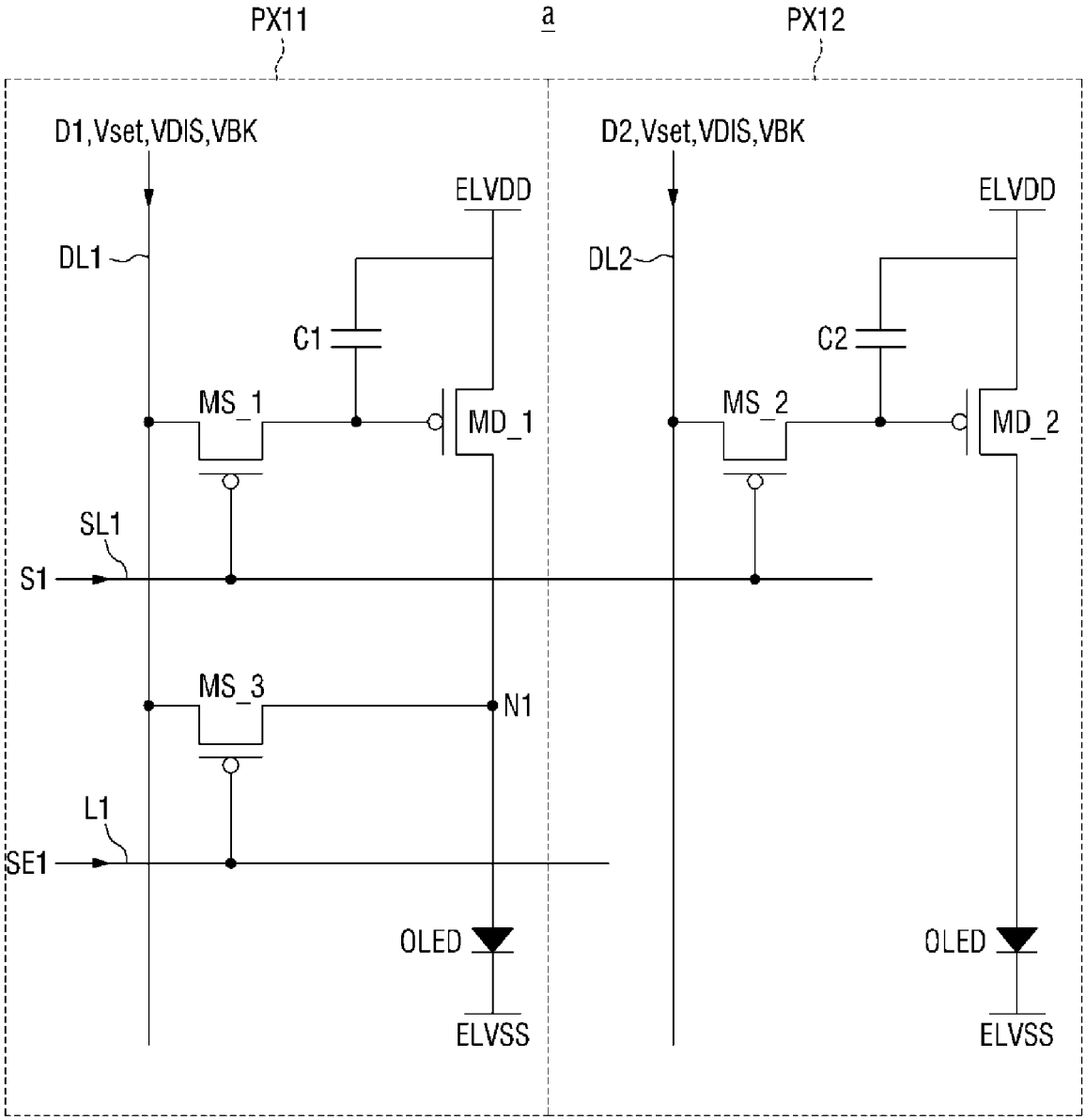
FIG. 2 is a circuit diagram of an area a of a display panel in the organic light-emitting display of FIG. 1.

FIG. 2 is a circuit diagram of an area a of the display panel 110 in the organic light-emitting display of FIG. 1. The area a of the display panel 110 illustrated in FIGS. 1 and 2 has been arbitrarily selected to describe the first and second pixels PX1 and PX2. The first pixel PX1 illustrated in FIG. 1 may correspond to PX11 in FIG. 2. The second pixel PX2 illustrated in FIG. 1 may correspond to PX12 in FIG. 2. That is, a pixel PX1 connected to the first scan line SL1, the first sensing line L1, and the first data line DL1 and a pixel PX2 connected to the first scan line SL1 and the second data line DL2 are illustrated in the circuit diagram. Therefore, the number of pixels included in the area a, the positions of the pixels, and the connection relationships of the pixels with data lines and a scan line are not limited to the example illustrated in FIGS. 1 and 2. Hereinafter, a pixel including the sensing transistor MS_3 will be described as a first pixel PX1, and a pixel not including the sensing transistor MS_3 will be described as a second pixel PX2.

First, the first pixel PX1 may include a first switch transistor MS_1, a first driving transistor MD_1, a sensing transistor MS_3, a first capacitor C1, and an organic light-emitting diode OLED. The first switch transistor MS_1 may include a gate electrode connected to the first scan line SL1 to receive the first scan signal S1, a first electrode connected to the first data line DL1 to receive the first data signal D1, and a second electrode connected to a first terminal of the first capacitor C1. The first switch transistor MS_1 may be turned on by the first scan signal S1 transmitted to the gate electrode through the first scan line SL1 and deliver the first data signal D1 received through the first data line DL1 to the first capacitor C1. The first driving transistor MD_1 may include a first electrode connected to the first power supply terminal ELVDD, a second electrode connected to a first node N1, and a gate electrode connected to the second electrode of the first switch transistor MS_1. The first driving transistor MD_1 may control a driving current supplied to the second power supply terminal ELVSS from the first power supply terminal ELVDD via the organic light-emitting diode OLED according to a voltage corresponding to the first data signal D1 transmitted to the gate electrode. The sensing transistor MS_3 may include a first electrode connected to the first data line DL1, a second electrode connected to the first node N1, and a gate electrode connected to the sensing line L1. The sensing transistor MS_3 may be turned on by the first sensing signal SE1 received through the first sensing line L1. The sensing transistor MS_3 may measure information about driving characteristics (e.g., a driving current) of the first driving transistor MD_1. In a sensing period, the sensing transistor MS_3 may measure an electric current flowing through the organic light-emitting diode OLED such that the measured electric current can be read out through the first sensing line L1. The organic light-emitting diode OLED may include an anode connected to the first node N1, a cathode connected to the second power supply terminal ELVSS, and an organic light-emitting layer. The organic light-emitting layer may emit light of one of primary colors. The primary colors may be three primary colors such as red, green and blue. The spatial or temporal sum of the three primary colors may produce a desired color. The organic light-emitting layer may include low molecular weight organic matter or polymer organic matter corresponding to each color. The organic matter corresponding to each color may emit light according to the amount of electric current flowing through the organic light-emitting layer. The first capacitor C1 may include the first terminal connected to the second electrode of the first switch transistor MS_1 and a second terminal connected to the first electrode of the first driving transistor MD_1. The first data signal D1 provided through the first data line DL1 may be transmitted to the first capacitor C1 by a switching operation of the first switch transistor MS_1. The first switch transistor MS_1, the first driving transistor MD_1 and the sensing transistor MS_3 may be, for example, p-type transistors.

Unlike the first pixel PX1, the second pixel PX2 may not include a sensing transistor. Therefore, the second pixel PX2 may include a second switch transistor MS_2, a second driving transistor MD_2, a second capacitor C2, and an organic light-emitting diode OLED. In addition, the second switch transistor MS_2 may have a first electrode connected to the second data line DL2 so as to receive the data signal D2. According to an embodiment, other elements of the second pixel PX2 are identical to those of the first pixel PX1, and thus a redundant description thereof will be omitted. Ultimately, the second pixel PX2, unlike the first pixel PX1, may not include a sensing transistor.

The first pixel PX1 may receive the reference voltage Vset, the first initialization voltage VDIS, and the second initialization voltage VBK through the first data line DL1. The second pixel PX2 may receive the reference voltage Vset, the first initialization voltage VDIS, and the second initialization voltage VBK through the second data line DL2. That is, the first and second pixels PX1 and PX2 may receive the reference voltage Vset of the same level through the first and second data lines DL1 and DL2. The reference voltage Vset applied to the first pixel PX1 may be provided to the organic light-emitting diode OLED by a switching operation of the sensing transistor MS_3, and a current measurement unit 121 (see FIG. 6) may measure an electric current flowing through the organic light-emitting diode OLED according to the reference voltage Vset. On the other hand, since the second pixel PX2 does not include a sensing transistor, the current measurement unit 121 may measure an electric current (for example, a leakage current) flowing through the second data line DL2 connected to the second pixel PX2. This will be described later with reference to FIG. 8.

Figure 3:
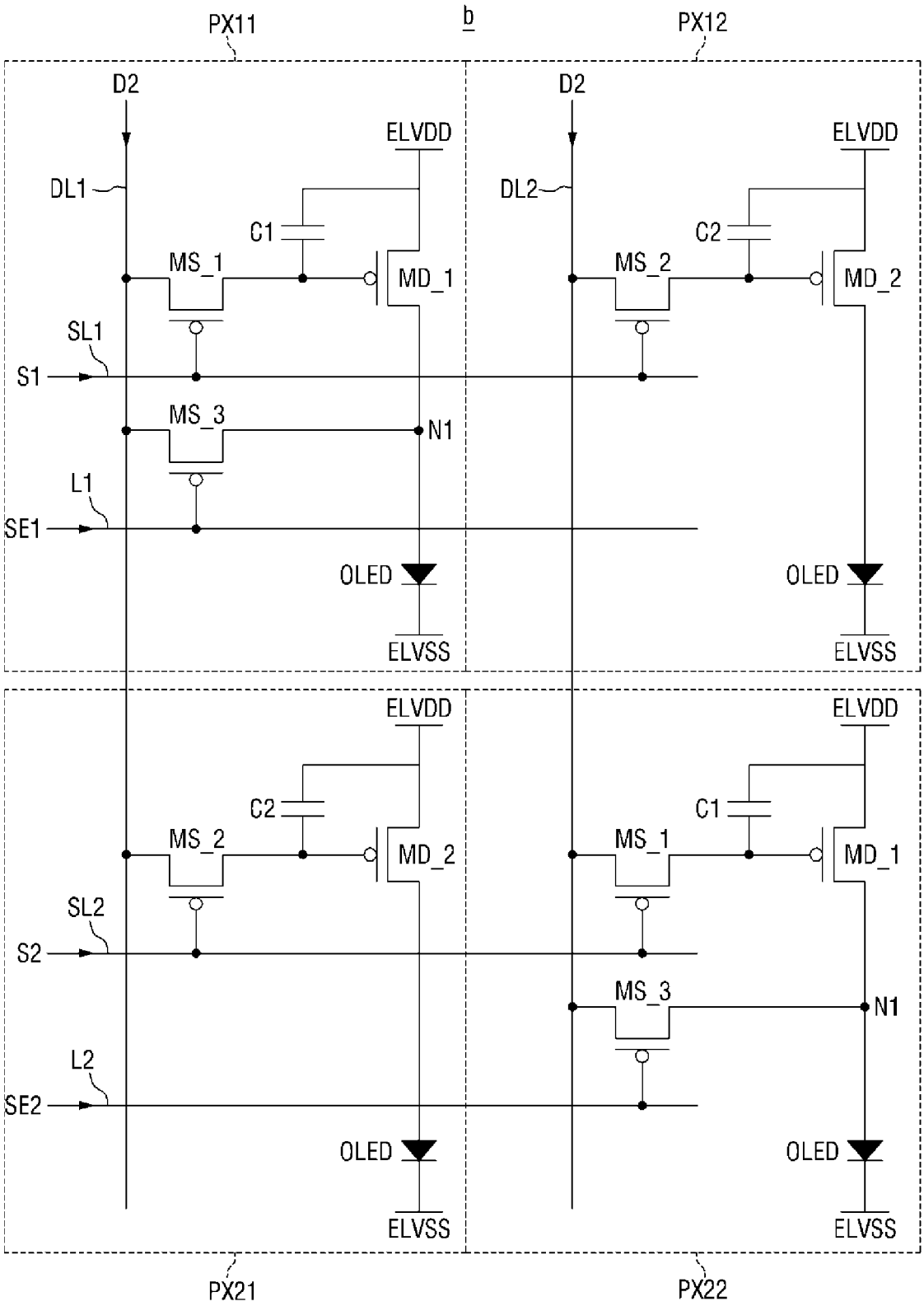
FIG. 3 is a circuit diagram of an area b of the display panel in the organic light-emitting display of FIG. 1.

FIG. 3 is a circuit diagram of an area b of the display panel 110 in the organic light-emitting display of FIG. 1.

Referring to FIG. 3, in the area b, a first pixel PX1 and a second pixel PX2 may alternate along each of the first and second data lines DL1 and DL2. The first pixels PX1 illustrated in FIG. 1 correspond to pixels PX11 and PX22 in FIG. 3. The second pixels PX2 illustrated in FIG. 1 correspond to pixels PX12 and PX21 in FIG. 3. Here, the number of pixels included in the area b, the positions of the pixels, and the connection relationships of the pixels with data lines and scan lines are not limited to the examples illustrated in FIGS. 1 and 3. A first pixel PX1 connected to the first data line DL1 may receive the reference voltage Vset, the first initialization voltage VDIS, and the second initialization voltage VBK through the first data line DL1. A first pixel PX1 connected to the second data line DL2 may receive the reference voltage Vset, the first initialization voltage VDIS, and the second initialization voltage VBK through the second data line DL2. Likewise, a second pixel PX2 connected to the first data line DL1 may receive the reference voltage Vset, the first initialization voltage VDIS, and the second initialization voltage VBK through the first data line DL1, and a second pixel PX connected to the second data line DL2 may receive the reference voltage Vset, the first initialization voltage VDIS, and the second initialization voltage VBK through the second data line DL2. The reference voltage Vset applied to the first pixel PX1 connected to one of the first and second data lines DL1 and DL2 may be provided to the organic light-emitting diode OLED by the switching operation of the sensing transistor MS_3, and the current measurement unit 121 (see FIG. 6) may measure an electric current flowing through the organic light-emitting diode OLED according to the reference voltage Vset. On the other hand, since the second pixel PX2 does not include a sensing transistor, the current measurement unit 121 may measure an electric current (for example, a leakage current) flowing through a data line connected to the second pixel PX2. The current measurement unit 121 (see FIG. 6) which measures an electric current flowing through the organic light-emitting diode OLED of the first pixel PX1 connected to the first data line DL1 can measure an electric current flowing through the second pixel PX2 connected to the second data line DL2. That is, the current measurement unit 121 (see FIG. 6) can measure an electric current flowing through each of the first and second pixels PX1 and PX2, in particular, an electric current flowing through each of the first and second pixels PX1 and PX2 connected to different data lines.

Figure 4:
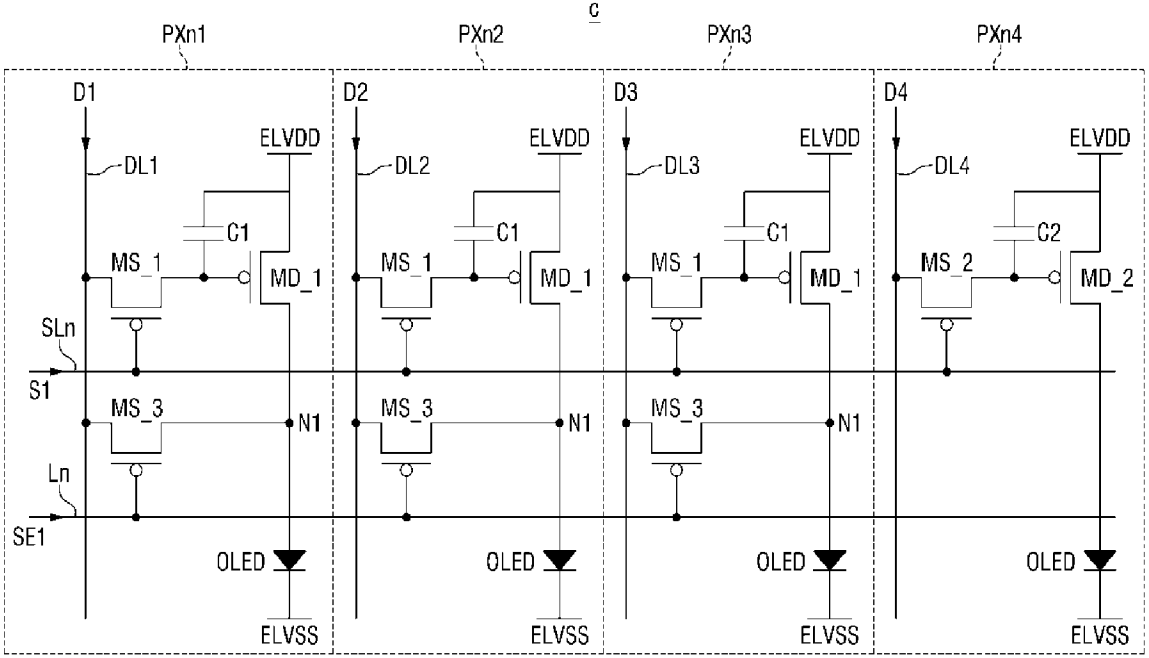
FIG. 4 is a circuit diagram of an area c of the display panel in the organic light-emitting display of FIG. 1.

FIG. 4 is a circuit diagram of an area c of the display panel 110 in the organic light-emitting display of FIG. 1.

Referring to FIG. 4, in the area c, a first pixel PX1 may be connected to the first through third data lines DL1 through DL3, and a second pixel PX2 may be connected to the fourth data line DL4. In FIG. 4, the current measurement unit 121 (see FIG. 6) can also measure an electric current flowing through each of the first and second pixels PX1 and PX2 connected to different data lines. The number of pixels included in the area c, the positions of the pixels, and the connection relationships of the pixels with data lines and scan lines are not limited to the examples illustrated in FIGS. 1 and 4.

Figure 5:
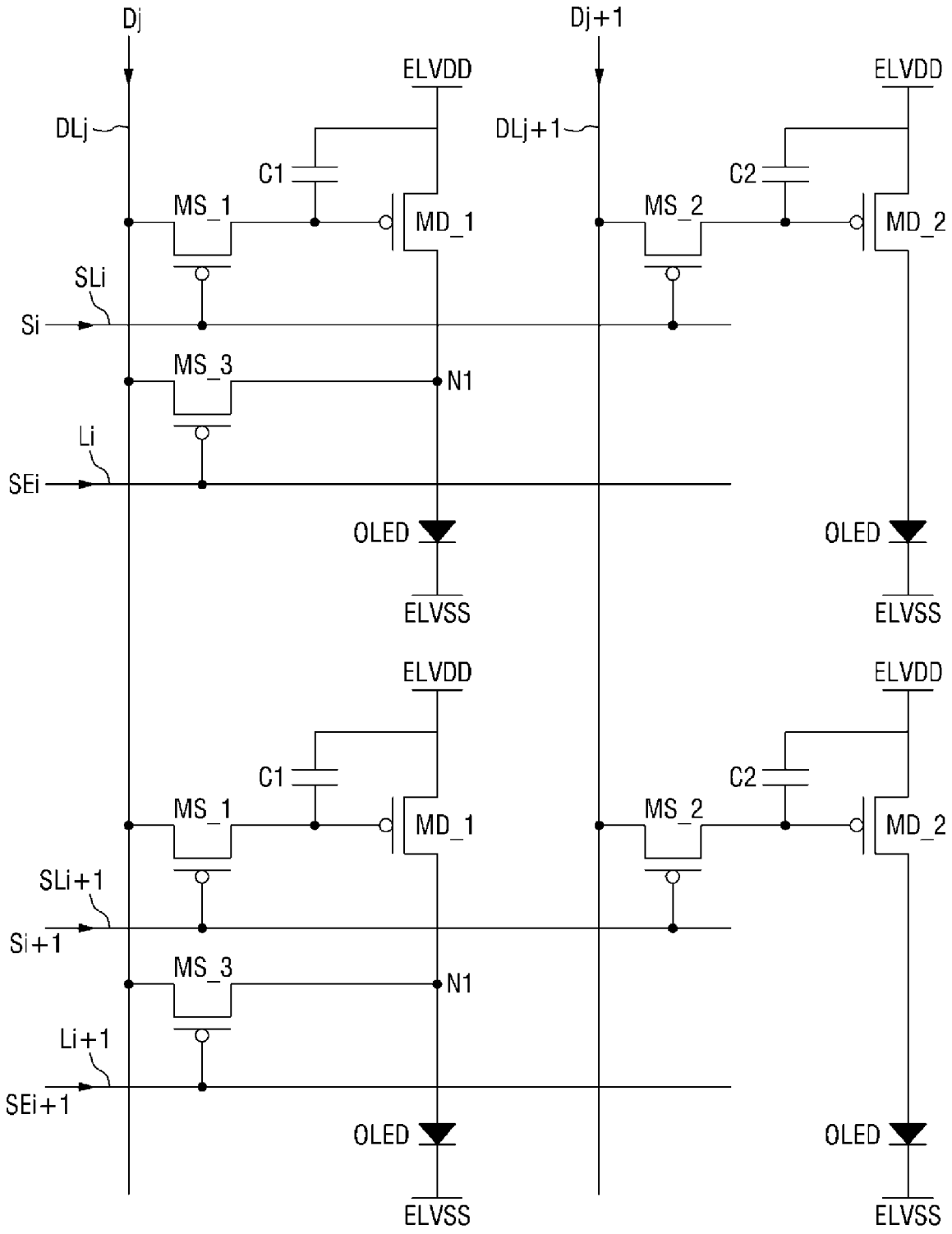
FIG. 5 is a circuit diagram of a portion of the display panel in the organic light-emitting display of FIG. 1.

FIG. 5 is a circuit diagram of a portion of the display panel 110 in the organic light-emitting display of FIG. 1. The circuit diagram of FIG. 5 illustrates four pixels, that is, a pixel PXij connected to an $i^{th}$ scan line SLi, an $i^{th}$ sensing line Li, and a $j^{th}$ data line DLj, a pixel PXi+1j connected to an $(i+1)^{th}$ scan line SLi+1, an $(i+1)^{th}$ sensing line Li+1, and the $j^{th}$ data line DLj, a pixel PXij+1 connected to the $i^{th}$ scan line SLi and a $(j+1)^{th}$ data line DLj+1, and a pixel PXi+1j+1 connected to the $(i+1)^{th}$ scan line SLi+1 and the $(j+1)^{th}$ data line DLj+1. Here, since the pixels PXij and PXi+1j each include the sensing transistor MS_3, they may be classified as first pixels PX1. On the other hand, since the pixels PXij+1 and PXi+1j+1 do not include the sensing transistor MS_3, they may be classified as second pixels PX2. That is, as an embodiment of the display panel 110 (see FIG. 1), a plurality of first pixels PX1 may be connected to one data line DLj of the data lines DL1 through DLm, and a plurality of second pixels PX2 may be connected to another one data line DLj+1 of the data lines DL1 through DLm. Accordingly, electric currents flowing through a plurality of pixels connected to a data line may be collectively measured in a way to be described later. On the other hand, a leakage current flowing through each data line may be maintained to be substantially equal. Thus, a signal to noise ratio (SNR) can be improved. In addition, since electric currents flowing through a plurality of pixels connected to a data line are collectively measured, the absolute magnitude of the measured electric current may increase, which may be useful (or advantageous) in a large-sized organic light-emitting display with high resolution.

As described above with reference to FIGS. 2 through 5, the first and second pixels PX1 and PX2 can be placed in various structures in the display panel 110 of the organic light-emitting display according to embodiments of the present invention. However, the first and second pixels PX1 and PX2 whose currents are measured can be connected to different data lines. A method of measuring electric currents flowing through the first and second pixels PX1 and PX2 connected to different data lines according to an embodiment will now be described.

Figure 6:
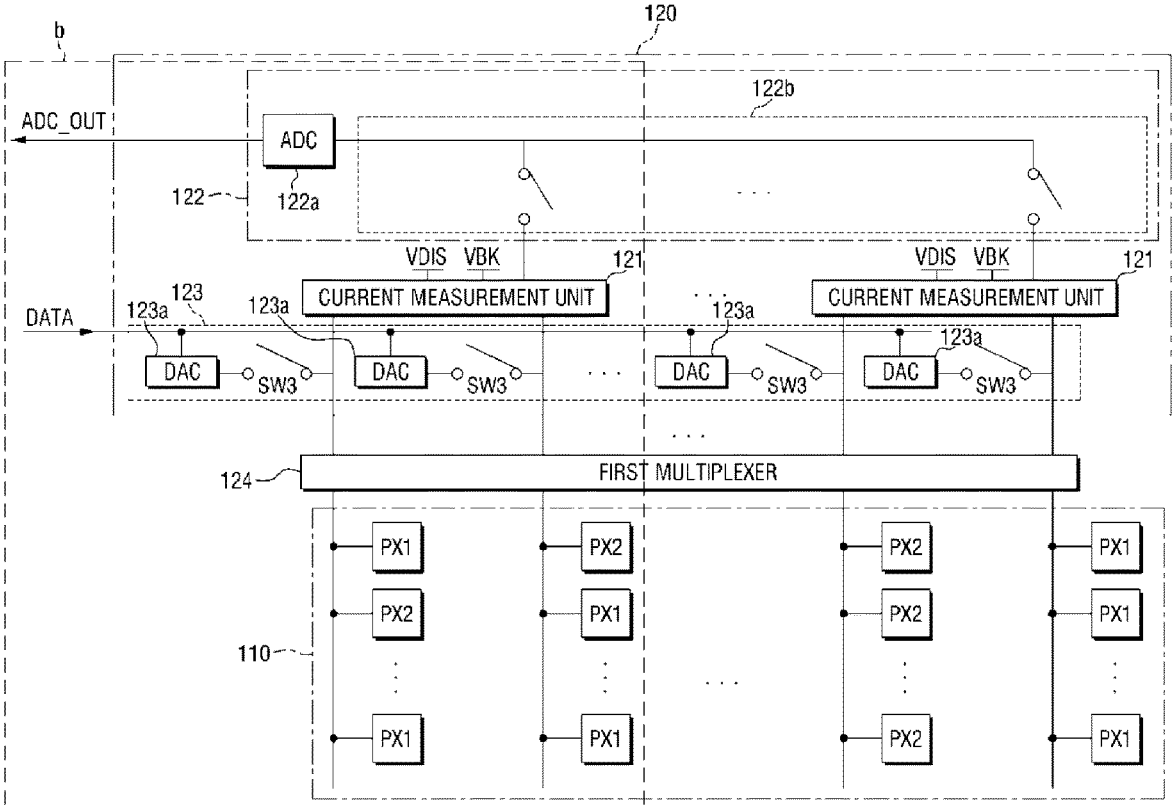
FIG. 6 is a block diagram illustrating an internal configuration of a data driver in the organic light-emitting display of FIG. 1.

FIG. 6 is a block diagram illustrating an internal configuration of the data driver 120 in the organic light-emitting display of FIG. 1.

Referring to FIG. 6, the data driver 120 may include the current measurement units 121, the data processing unit 122, the data provider 123, and the first multiplexer 124.

The current measurement units 121 may be connected to the pixels PX by the data lines DL1 through DLm. Each of the current measurement units 121 may be connected to two data lines. Here, one of the two data lines may be connected to first pixels PX1, and the other one may be connected to second pixels PX2. The current measurement units 121 may operate as current integrators in a sensing period and as output buffers in a display period. According to an embodiment, the sensing period is a period of time during which an electric current flowing through an organic light-emitting diode OLED is measured to determine a compensation value, and the display period is a period of time during which the image data DATA is compensated using the compensation value and then output to the display panel 110. The current measurement units 121 may receive the first initialization voltage VDIS and the second initialization voltage VBK from the power providing unit. The current measurement units 121 will be described later with reference to FIG. 7.

The data processing unit 122 may include an analog-to-digital converter (ADC) 122*a* and a second multiplexer 122*b*. The second multiplexer 122*b* may be connected between output terminals of the current measurement units 121 and the ADC 122*a*. The second multiplexer 122*b* may provide output signals of the current measurement units 121 to the ADC 122*a* through a switching operation. For the switching operation of the second multiplexer 122*b*, the data processing unit 122 according to an embodiment of the present invention may further include a shift register. Therefore, the second multiplexer 122*b* may provide the output signals of the current measurement units 121 to the ADC 122*a* under the control of the shift register. The ADC 122*a* may convert the output signals of the current measurement units 121 into digital signals ADC_OUT and provide the digital signals ADC_OUT to the timing controller 130. In some embodiments the ADC 122*a* may be implemented as a pipelined ADC, a successive approximation register (SAR) ADC, or a single-slope type ADC.

The data provider 123 may be connected to each of the data lines DL1 through DLm. The data provider 123 may convert the image data DATA received from the timing controller 130 into the data signals D1 through Dm in an analog form and provide the data signals D1 through Dm respectively to the data lines DL1 through DLm. To this end, the data provider 123 may include a plurality of digital-to-analog converters (DACs) 123*a* and a plurality of third switches SW3 connected between the DACs 123*a* and the data lines DL1 through DLm, respectively. The third switches SW3 may be, for example, n-type switches. The DACs 123*a* may convert the image data DATA in a digital form received from the timing controller 130 into the data signals D1 through Dm in an analog form. The third switches SW3 may perform switching operations in response to the third control signal ϕreceived from the timing controller 130. The third switches SW3 may be turned on by the third control signal ϕ3 in the display period, thereby connecting signal paths between the DACs 123*a* and the data lines DL1 through DLm connected one-to-one to the DACs 123*a*.

The first multiplexer 124 may be connected between the current measurement units 121 and the display panel 110 and may include a plurality of switches. That is, the first multiplexer 124 may connect or block signal paths between the first or second pixels PX1 or PX2 of the display panel 110 and the current measurement units 121 through the switching operations of the switches. For the switching operation of the first multiplexer 124, the data driver 120 according to an embodiment of the present invention may further include a first shift register. The first multiplexer 124 may connect or block the signal paths between the current measurement units 121 and the first or second pixels PX1 or PX2 of the display panel 110 under the control of the first shift register. Therefore, the organic light-emitting display according to the current embodiment of the present invention may connect 2*n* (where n is a natural number) or more data lines to one current measurement unit 121 through the first multiplexer 124.

Figure 7:
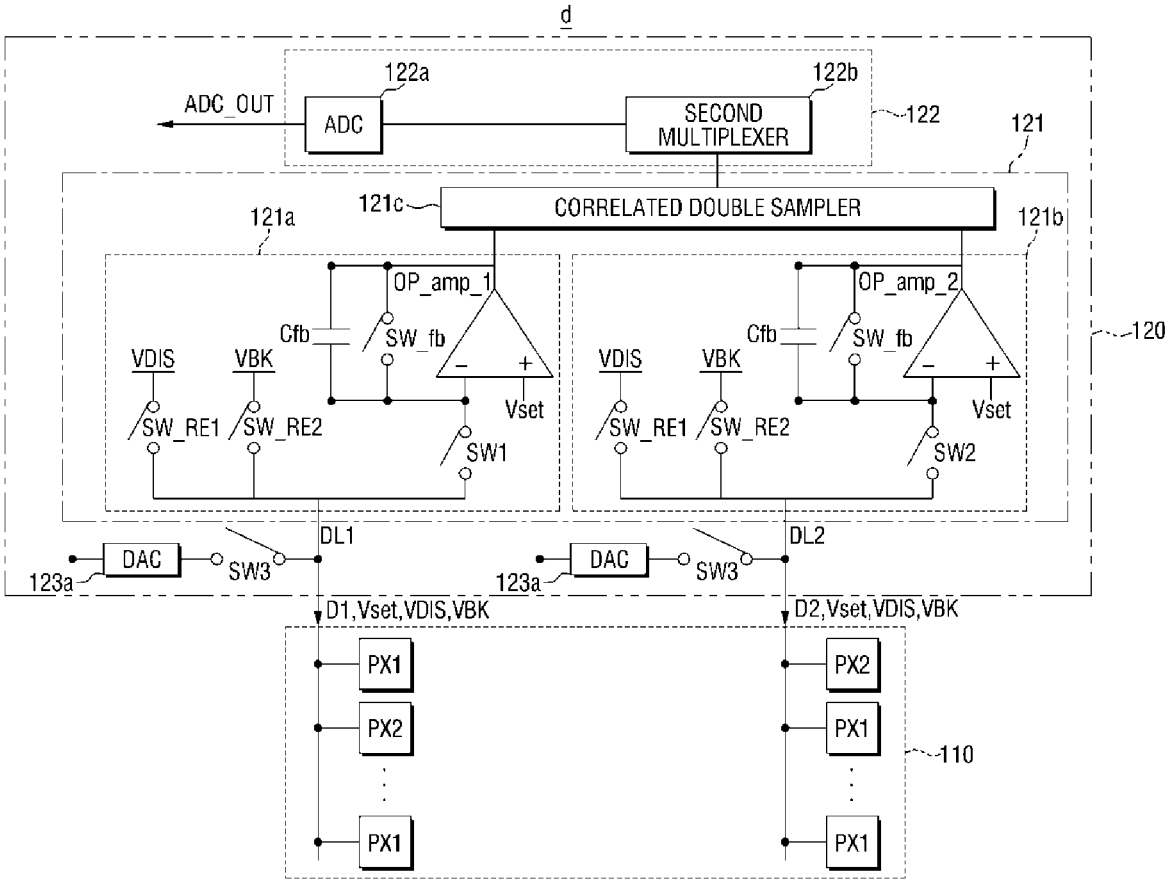
FIG. 7 is a circuit diagram illustrating an internal configuration of a current measurement unit in the data driver of FIG. 6.

FIG. 7 is a circuit diagram illustrating an internal configuration of a current measurement unit 121 in the data driver 120 of FIG. 6.

Referring to FIG. 7, the current measurement unit 121 may include a first measurement circuit 121*a*, a second measurement circuit 121*b*, and a correlated double sampler (CDS) 121*c*. In an area d of FIG. 7, the first measurement circuit 121*a* is connected to the first data line DL1, and the second measurement circuit 121*b* is connected to the second data line DL2. The first measurement circuit 121*a* may measure an electric current flowing through one of the first and second pixels PX1 and PX2 connected to the first data line DL1, and the second measurement circuit 121*b* may measure an electric current flowing through the other one of the first and second pixels PX1 and PX2 connected to the second data line DL2.

The first measurement circuit 121*a* may include a first operational amplifier OP_amp_1, a feedback capacitor Cfb, a feedback switch SW_fb, a first switch SW1, a first initialization switch SW_RE1, and a second initialization switch SW_RE2. The feedback switch SW_fb, the first initialization switch SW_RE1, and the second initialization switch SW_RE2 may be, for example, n-type switches. The first operational amplifier OP_amp_1 may include an inverting input terminal (−), a non-inverting input terminal (+), and an output terminal. A reference voltage Vset from the power providing unit may be applied to the non-inverting input terminal (+) of the first operational amplifier OP_amp_1. To allow the first measurement circuit 121*a* to read out signal and noise, the reference voltage Vset may be a voltage corresponding to (signal+noise), for example, may be at a level higher than a threshold voltage Vth of the organic light-emitting diode OLED in each of the first pixels PX1. The first switch SW1 may be connected between the inverting input terminal (−) of the first operational amplifier OP_amp_1 and the first data line DL1 and perform a switching operation in response to the first control signal ϕ1. The feedback capacitor Cfb may have a first terminal connected to the inverting input terminal (−) of the first operational amplifier OP_amp_1 and a second terminal connected to the output terminal of the first operational amplifier OP_amp_1. The feedback switch SW_fb may be connected in parallel to the feedback capacitor Cfb between the inverting input terminal (−) of the first operational amplifier OP_amp_1 and the output terminal of the first operational amplifier OP_amp_1. The feedback switch SW_fb may perform a switching operation in response to the feedback control signal fb from the timing controller 120. The first initialization switch SW_RE1 may be connected between the power providing unit and the first data line DL1 and perform a switching operation in response to the first initialization control signal Re1 from the timing controller 120. The second initialization switch SW_RE2 may be connected between the power providing unit and the first data line DL1 and perform a switching operation in response to the second initialization control signal Re2 from the timing controller 120.

The second measurement circuit 121*b* may include a second operational amplifier OP_amp_2, a feedback capacitor Cfb, a feedback switch SW_fb, a second switch SW2, a first initialization switch SW_RE1, and a second initialization switch SW_RE2. The second operational amplifier OP_amp_2 may include an inverting input terminal (−), a non-inverting input terminal (+), and an output terminal. The same reference voltage Vset as the reference voltage Vset applied from the power providing unit to the non-inverting input terminal (+) of the first operational amplifier OP_amp_1 may be provided to the non-inverting input terminal (+) of the second operational amplifier OP_amp_2. Other elements of the second measurement circuit 121*b* are substantially identical to those of the first measurement circuit 121*a*, and thus a redundant description thereof will be omitted.

The CDS 121*c* may be connected between output terminals of the first and second measurement circuits 121*a* and 121*b* (for example, the output terminals of the first and second operational amplifiers OP_amp_1 and OP_amp_2) and the second multiplexer 122*b*. The CDS 121*c* may perform correlated double sampling on output signals of the first and second operational amplifiers OP_amp_1 and OP_amp_2 under the control of the timing controller 130. The CDS 121*c* may detect a potential difference between the output signals of the first and second operational amplifiers OP_amp_1 and OP_amp_2 and provide the detected potential difference to the ADC 122*a*. The CDS 121*c* can maintain a good SNR by performing correlated double sampling on the output signals of the first and second operational amplifiers OP_amp_1 and OP_amp_2.

Figure 8:
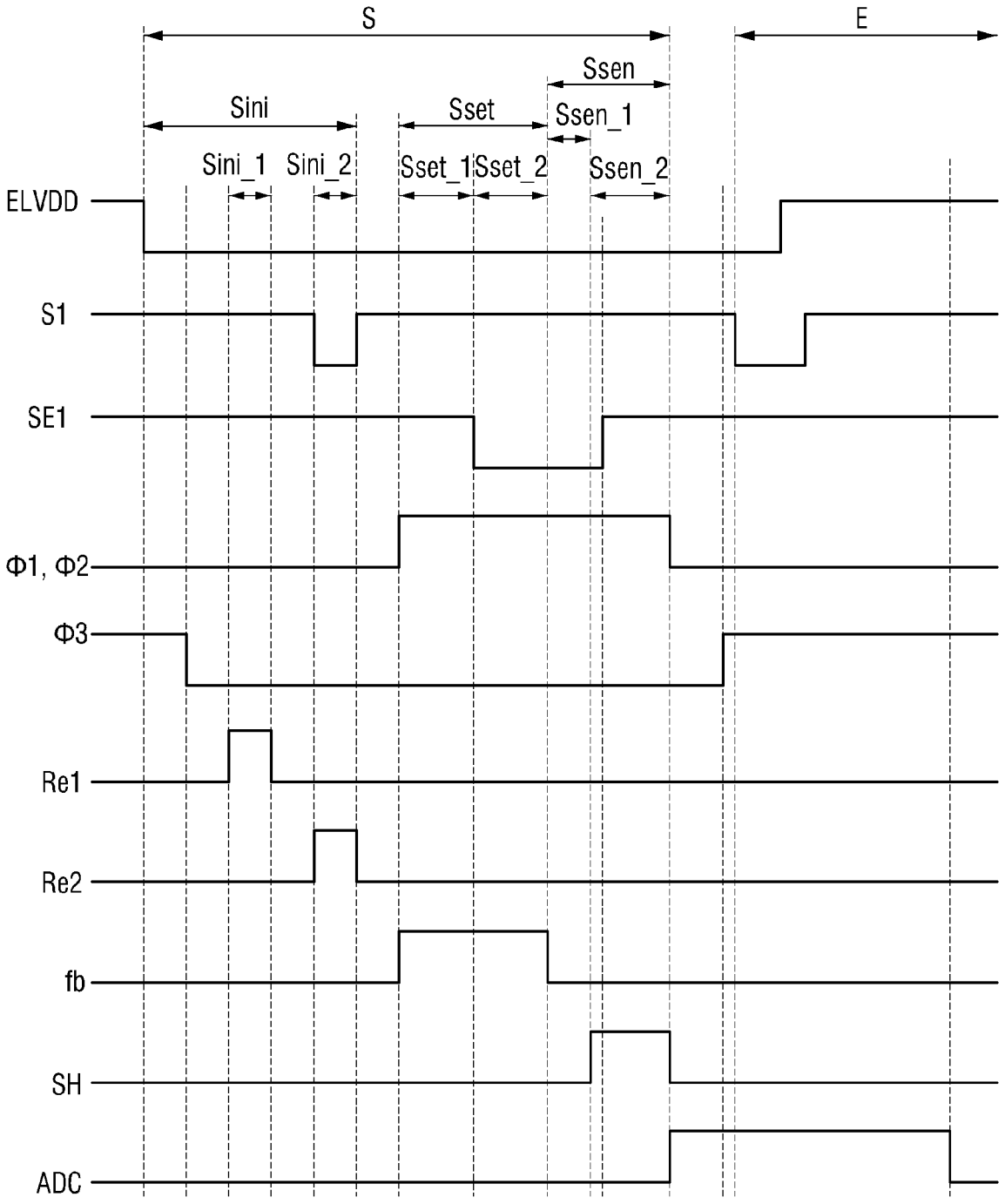
FIG. 8 is a timing diagram illustrating a method of driving the organic light-emitting display of FIG. 1.
Figure 9:
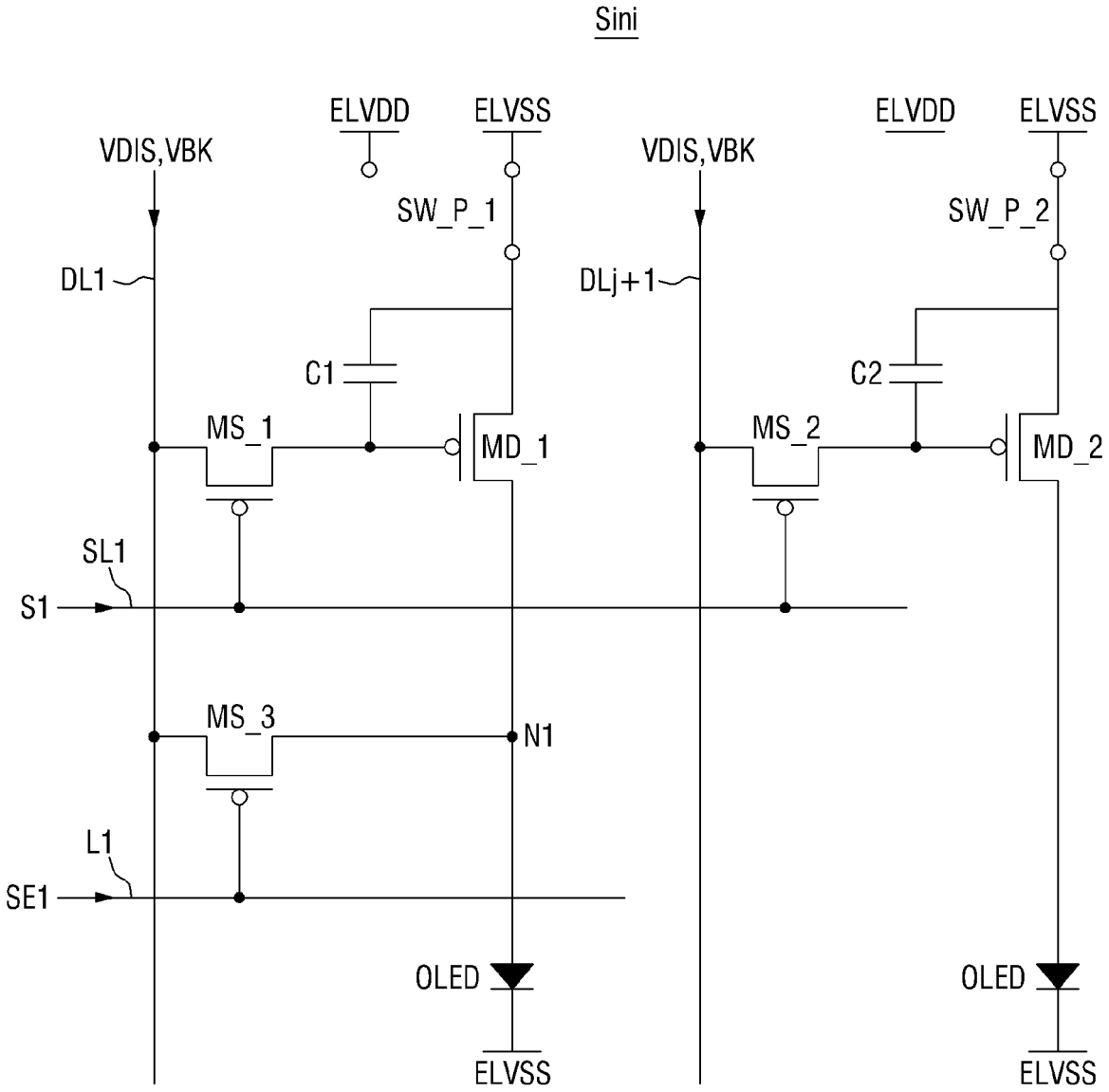
FIG. 9 is a circuit diagram illustrating an operating state of the organic light-emitting display of FIG. 1 in an initialization period according to an embodiment of the present invention.
Figure 10:
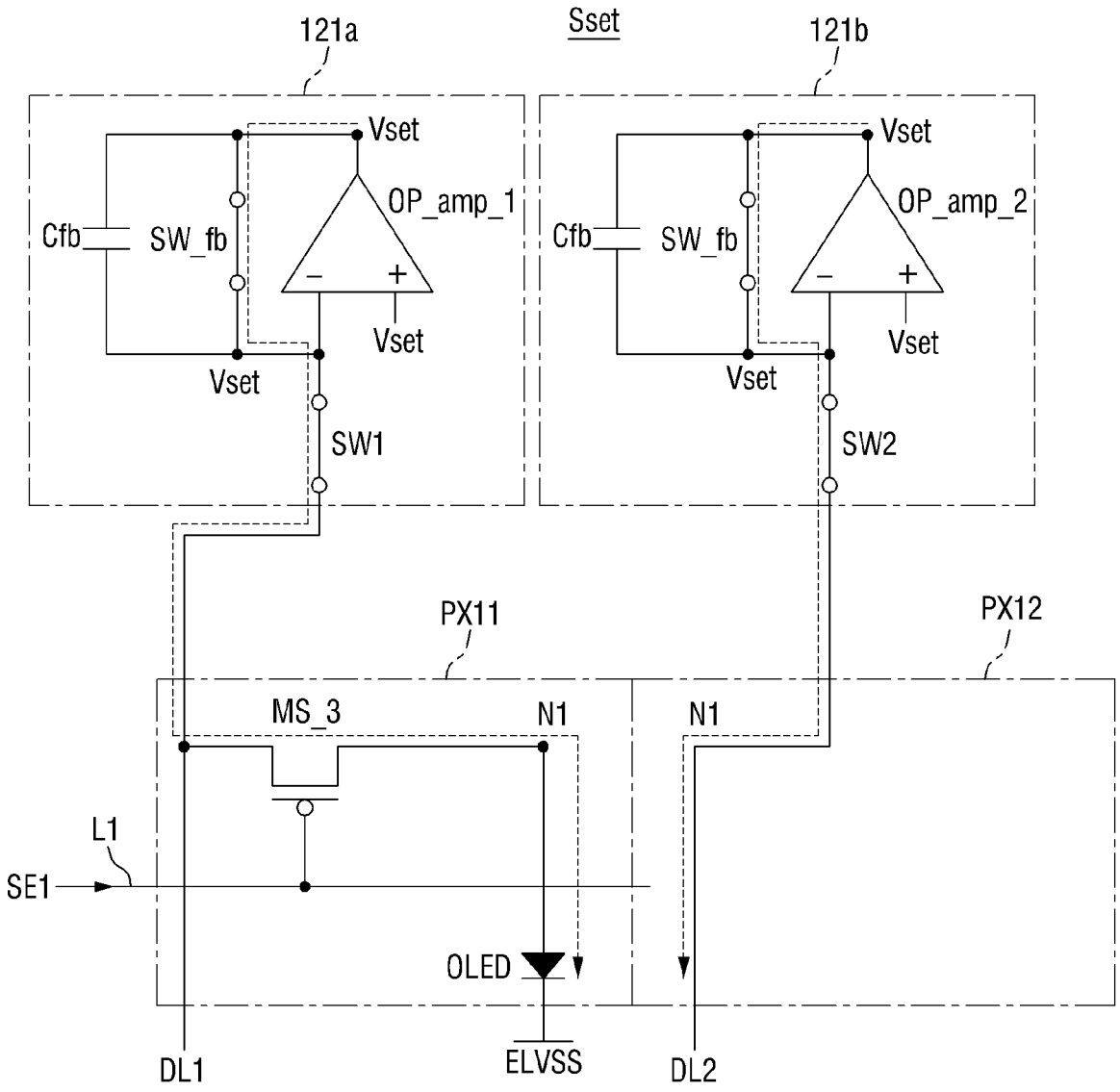
FIG. 10 is a circuit diagram illustrating an operating state of the organic light-emitting display of FIG. 1 in a reference voltage applying period according to an embodiment of the present invention.
Figure 11:
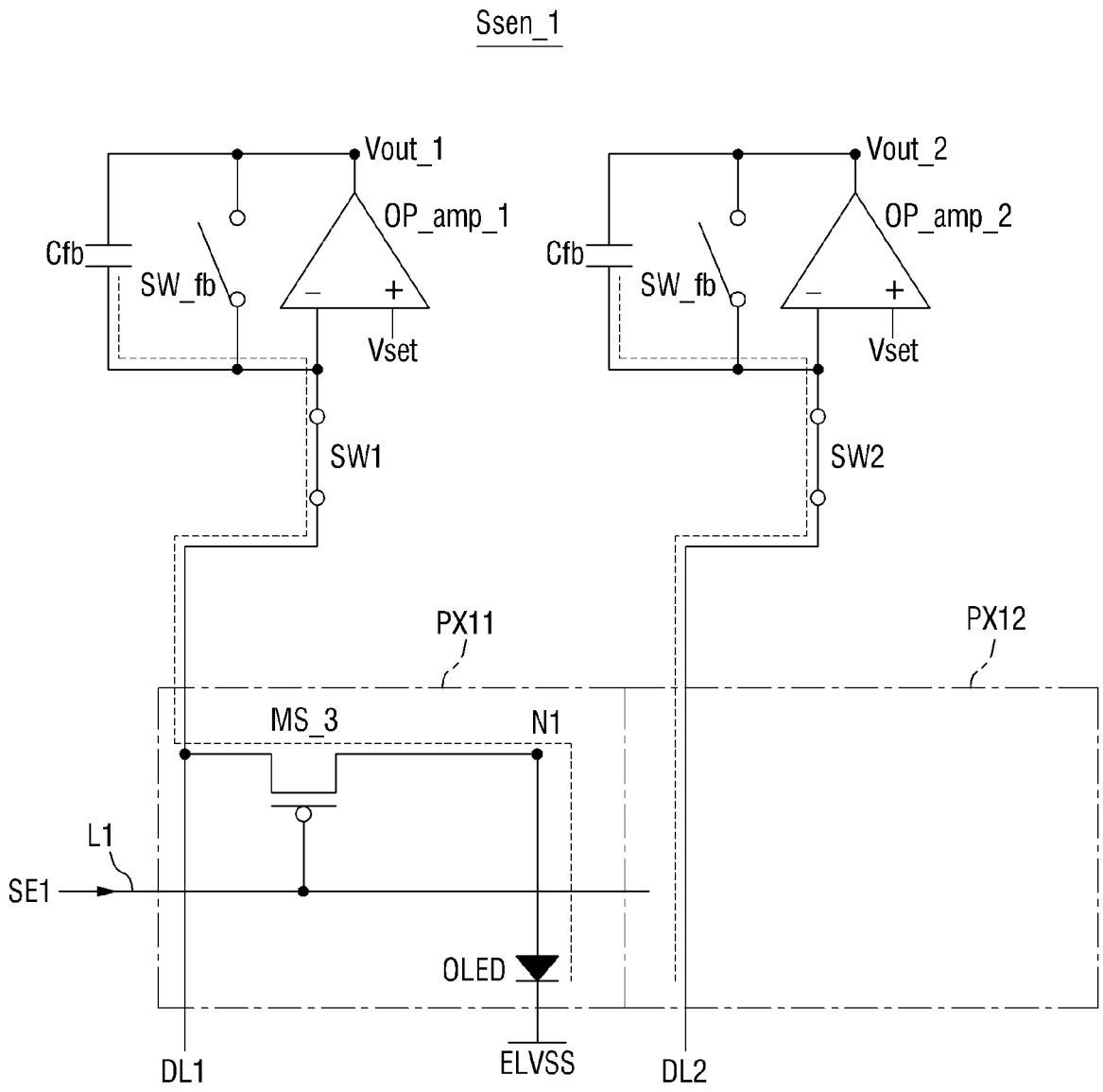
FIG. 11 is a circuit diagram illustrating an operating state of the organic light-emitting display of FIG. 1 in a measurement period according to an embodiment of the present invention.

FIG. 8 is a timing diagram illustrating a method of driving the organic light-emitting display of FIG. 1. FIG. 9 is a circuit diagram illustrating an operating state of the organic light-emitting display of FIG. 1 in an initialization period Sini according to an embodiment of the present invention. FIG. 10 is a circuit diagram illustrating an operating state of the organic light-emitting display of FIG. 1 in a reference voltage applying period Sset according to an embodiment of the present invention. FIG. 11 is a circuit diagram illustrating an operating state of the organic light-emitting display of FIG. 1 in a measurement period Ssen according to an embodiment of the present invention. In FIGS. 8 through 11, the area a of FIG. 1 will be described. That is, a first pixel PX1 located between the first data line DL1 and the first scan line SL1 and a second pixel PX2 located between the second data line DL2 and the first scan line SL1 will be described as an example. Here, the positions of the first and second pixels PX1 and PX2 and the connection relationships of the first and second pixels PX1 and PX2 with the data lines DL1 and DL2 are not limited to the example illustrated in the drawings.

Referring to FIG. 8, the organic light-emitting display according to an embodiment of the present invention may operate largely in two periods: a sensing period S and a display period E. In one embodiment, the sensing period S is a period of time during which electric currents flowing through a plurality of organic light-emitting diodes OLED are measured to calculate current-voltage characteristics of the organic light-emitting diodes OLED. The sensing period S may be activated when the power of the organic light-emitting display is turned off or turned on. That is, the sensing period S may be activated during a standby time in which the power is turned on or off. However, the present invention is not limited thereto, and the sensing period S can also be activated at regular intervals or by a user's setting. The sensing period S may be divided into the initialization period Sini, the reference voltage applying period Sset, and the measurement period Ssen. The initialization period Sini may include a first initialization period Sini_1 during which all data lines DL1 through DLm charged with an arbitrary voltage due to coupling are charged with the first initialization voltage VDIS and a second initialization period Sini_2 during which the first and second capacitors C1 and C2 are charged with the second initialization voltage VBK to prevent a leakage current from leaking to the first power supply terminal ELVDD during current measurement. Here, the order of the first and second initialization periods Sini_1 and Sini_2 can be reversed. The reference voltage applying period Sset is a period of time during which the reference voltage Vset is applied to the anode of the organic light-emitting diode OLED included in the first pixel PX1 and to the second data line DL2 connected to the second pixel PX2. The measurement period Ssen is a period of time during which an electric current flowing through the organic light-emitting diode OLED as the reference voltage Vset is applied to the anode of the organic light-emitting diode OLED included in the first pixel PX and an electric current flowing through the second data line DL2 connected to the second pixel PX2 are measured. Here, the electric current flowing through the second data line DL2 connected to the second pixel PX2 may be a leakage current.

An operation of the organic light-emitting display in the initialization period Sini of the sensing period S will now be described with reference to FIGS. 8 and 9. Here, while a voltage applied to the first and second driving transistors MD_1 and MD_2 is labeled as ELVDD, as shown, the voltage switches between a high level (e.g., ELVDD) and a low level (e.g., ELVSS). First, a voltage level applied to the first and second driving transistors MD_1 and MD_2 may be lowered from the voltage level of the first power supply terminal ELVDD to the voltage level of the second power supply terminal ELVSS. To this end, the first and second pixels PX1 and PX2 may further include power switches (SW_P_1 and SW_P_2), respectively. In FIG. 9, the power switches (SW_P_1 and SW_P_2) are divided into a first power switch SW_P_1 and a second power switch SW_P_2. However, this is merely intended for ease of description, and the first and second power switches SW_P_1 and SW_P_2 may actually perform the same operation. The first and second power switches SW_P_1 and SW_P_2 may be connected between power supply lines respectively connected to the first and second driving transistors MD_1 and MD_2 and the first and second power supply terminals ELVDD and ELVSS, and perform switching operations under the control of the timing controller 130. In the sensing period S, the first and second power switches SW_P_1 and SW_P_2 may respectively connect signal paths between the first electrodes of the first and second driving transistors MD_1 and MD_2 and the second power supply terminal ELVSS through their switching operations, thereby lowering an electric potential respectively applied to the first and second driving transistors MD_1 and MD_2 from an electric potential of the first power supply terminal ELVDD to an electric potential of the second power supply terminal ELVSS. In the present specification, a case where a voltage level applied to the first and second driving transistors MD_1 and MD_2 is lowered from the voltage level of the first power supply terminal ELVDD to the voltage level of the second power supply terminal ELVSS by the switching operation of a power switch SW_P (or power switches SW_P_1 and SW_P_2) is described as an example. However, the present invention is not limited to this case. That is, an electric potential respectively applied to the first and second driving transistors MD_1 and MD_2 can also be increased from the electric potential of the second power supply terminal ELVSS to the electric potential of the first power supply terminal ELVDD. After, the third control signal ϕ3 at a low level may be generated, thereby turning off the third switches SW3 in the data provider 123. Accordingly, this can prevent the provision of the data signals D1 and D2 through the first and second data lines DL1 and DL2, respectively.

In the first initialization period Sini_1, the first initialization control signal Re1 at a high level may be generated, thereby turning on the first initialization switch SW_RE1. The first scan signal S1 and the first sensing signal SE1 may maintain a high level to continuously turn off the first and second switch transistors MS_1 and MS_2 and the sensing transistor MS_3. In addition, the first through third control signals ϕ1 through ϕ3, the second initialization control signal Re2 and the feedback control signal fb may maintain a low level to continuously turn off the first through third switches SW1 through SW3, the second initialization switch SW_RE2 and the feedback switch SW_fb. When a voltage level applied to the first and second driving transistors MD_1 and MD_2 is lowered from the voltage level of the first power supply terminal ELVDD to the voltage level of the second power supply terminal ELVSS, the data lines DL1 through DLm may be charged with an arbitrary voltage due to coupling. However, if this state continues, adjacent pixels may emit light when electric currents of the first and second pixels PX1 and PX2 are measured. Accordingly, an image can be distorted. To reduce (or prevent) the distortion of the image, the first and second data lines DL1 and DL2 connected to the first and second pixels PX1 and PX2 and the other data lines may be charged with the first initialization voltage VDIS. Here, the level of the first initialization voltage VDIS may be lower than that of the threshold voltage Vth of the organic light-emitting diode OLED in each of the first and second pixels PX1 and PX2.

In the second initialization period Sini_2, the second initialization control signal Re2 at a high level may be generated, thereby turning on the second initialization switch SW_RE2. In addition, the first scan signal S1 may be inverted to a low level, thereby turning on the first and second switch transistors MS_1 and MS_2. The first sensing signal SE1 may maintain a high level to continuously turn off the sensing transistor MS_3. The first through third control signals ϕ1 through ϕ3, the first initialization control signal Re1 and the feedback control signal fb may maintain a low level to continuously turn off the first through third switches SW1 through SW3, the first initialization switch SW_RE1, and the feedback switch SW_fb. Therefore, in the second initialization period Sini_2, as the second initialization switch SW_RE2 and the first and second switch transistors MS_1 and MS_2 are turned on, the first and second capacitors C1 and C2 may be charged with the second initialization voltage VBK. Accordingly, this can reduce (or prevent) the generation of a leakage current in the first power supply terminal ELVDD during current measurement. The level of the second initialization voltage VBK may be higher than that of the reference voltage Vset.

The operation of the organic light-emitting display in the reference voltage applying period Sset of the sensing period S will now be described with reference to FIGS. 8 and 10.

The reference voltage applying period Sset may include a first reference voltage applying period Sset_1 during which the feedback control signal fb is inverted to a high level to turn on the feedback switch SW_fb and a second reference voltage applying period Sset_2 during which the feedback control signal fb is inverted back to a low level to turn off the feedback switch SW_fb.

In the first reference voltage applying period Sset_1, the feedback control signal fb is inverted to a high level to turn on the feedback switch SW_fb. The first and second control signals ϕ1 and ϕ2 may be inverted to a high level to turn on the first and second switches SW1 and SW2. The first scan signal S1 may maintain (or be inverted to) a high level to turn off the first and second switch transistors MS_1 and MS_2. The first sensing signal SE1 may maintain a high level to continuously turn off the sensing transistor MS_3. The third control signal ϕ3 and the first and second initialization control signals Re1 and Re2 may maintain a low level to continuously turn off the third switch SW3 and the first and second initialization switches SW_RE1 and SW_RE2.

In the case of the first pixel PX1 (or PX11), the non-inverting input terminal (+) of the first operational amplifier OP_amp_1 in the first measurement circuit 121*a* may receive the reference voltage Vset. In addition, the inverting input terminal (−) of the first operational amplifier OP_amp_1 and the output terminal of the first operational amplifier OP_amp_1 may short-circuit with each other. The inverting input terminal (−) of the first operational amplifier OP_amp_1 may be connected to the first pixel PX1 by the first data line DL1. The feedback capacitor Cfb of the first measurement circuit 121*a* may be reset due to the short circuit between the inverting input terminal (−) of the first operational amplifier OP_amp_1 and the output terminal of the first operational amplifier OP_amp_1. An electric potential of the output terminal of the first operational amplifier OP_amp_1 may be maintained with the reference voltage Vset, and an electric potential of the inverting input terminal (−) of the first operational amplifier OP_amp_1 may also be maintained with the reference voltage Vset due to virtual grounding characteristics of the first operational amplifier OP_amp_1. This reference voltage Vset may charge the first data line DL1.

In the case of the second pixel PX2 (or PX 12), the non-inverting input terminal (+) of the second operational amplifier OP_amp_2 in the second measurement circuit 121*b* may receive the reference voltage Vset. In addition, the inverting input terminal (−) of the second operational amplifier OP_amp_2 and the output terminal of the second operational amplifier OP_amp_2 may short-circuit with each other. The inverting input terminal (−) of the second operational amplifier OP_amp_2 may be connected to the second pixel PX2 by the second data line DL2. The feedback capacitor Cfb of the second measurement circuit 121*b* may be reset due to the short circuit between the inverting input terminal (−) of the second operational amplifier OP_amp_2 and the output terminal of the second operational amplifier OP_amp_2. An electric potential of the output terminal of the second operational amplifier OP_amp_2 may be maintained with the reference voltage Vset, and an electric potential of the inverting input terminal (−) of the second operational amplifier OP_amp_2 may be maintained with the reference voltage Vset due to virtual ground characteristics of the second operational amplifier OP_amp_2. The reference voltage Vset may charge the second data line DL2.

In the second reference voltage applying period Sset_2, the feedback control signal fb may be inverted back to a low level to turn off the feedback switch SW_fb. The first sensing signal SE1 may be inverted to (or maintain) a low level to turn on the sensing transistor MS_3. The first and second control signals ϕ1 and ϕ2 may maintain (or be inverted to) a high level to turn on the first and second switches SW1 and SW2. The first scan signal S1 may maintain a high level to continuously turn off the first and second switch transistors MS_1 and MS_2. The third control signal ϕ3 and the first and second initialization control signals Re1 and Re2 may maintain a low level to continuously turn off the third switch SW3 and the first and second initialization switches SW_RE1 and SW_RE2.

In the case of the first pixel PX1, as the sensing transistor MS_3 is turned on, the reference voltage Vset charged in the first data line DL1 may be applied to the anode of the organic light-emitting diode OLED in the first pixel PX1. Here, since the reference voltage Vset has a voltage value equal to or higher than the threshold voltage Vth of the organic light-emitting diode OLED included in the first pixel PX1, an electric current may flow through the organic light-emitting diode OLED in the first pixel PX1. The magnitude of the electric current flowing through the organic light-emitting diode OLED may vary according to the degree of degradation of the organic light-emitting diode OLED.

Since the second pixel PX2 does not include a sensing transistor, the reference voltage Vset is not applied to the organic light-emitting diode OLED in the second pixel PX2. However, a leakage current generated by the second switch transistor MS_2 and the second driving transistor MD_2 may flow through the second data line DL2.

The operation of the organic light-emitting display in the measurement period Ssen of the sensing period S will now be described with reference to FIGS. 8 and 11. The measurement period Ssen may include a first measurement period Ssen_1 following the reference voltage applying period Sset and a second measurement period Ssen_2 following the first measurement period Ssen_1.

In the first measurement period Ssen_1, the feedback control signal fb may be inverted to a low level to turn off the feedback switch SW_fb. The first and second control signals ϕ1 and ϕ2 may be maintained at a high level to continuously turn on the first and second switches SW1 and SW2. The first sensing signal SE1 may be maintained at a low level to continuously turn on the sensing transistor MS_3. The first scan signal S1 may be maintained at a high level to continuously turn off the first and second switch transistors MS_1 and MS_2. The third control signal ϕ3 and the first and second initialization control signals Re1 and Re2 may maintain a low level to continuously turn off the third switch SW3 and the first and second initialization switches SW_RE1 and SW_RE2.

In the case of the first pixel PX1 (or PX11), the short circuit between the inverting input terminal (−) of the first operational amplifier OP_amp_1 and the output terminal of the first operational amplifier OP_amp_1 in the first measurement circuit 121*a* may be removed. Accordingly, the first operational amplifier OP_amp_1 can operate as an integrator. The inverting input terminal (−) of the first operational amplifier OP_amp_1 may be continuously connected to the organic light-emitting diode OLED of the first pixel PX1 by the first switch SW1. The feedback capacitor Cfb in the first measurement circuit 121*a* may be charged with a voltage corresponding to an electric current flowing through the organic light-emitting diode OLED and a voltage corresponding to a leakage current in the first pixel PX1. The leakage current may be generated in the first switch transistor MS_1, the first driving transistor MD_1, etc. Accordingly, an electric potential (Vout_1) of the output terminal of the first operational amplifier OP_amp_1 may increase linearly from the reference voltage Vset according to the voltage corresponding to the electric current flowing through the organic light-emitting diode OLED and the voltage corresponding to the leakage current in the first pixel PX1.

In the case of the second pixel PX2 (or PX12), the short circuit between the inverting input terminal (−) of the second operational amplifier OP_amp_2 and the output terminal of the second operational amplifier OP_amp_2 in the second measurement circuit 121*b* may be removed. Accordingly, the second operational amplifier OP_amp_1 can operate as an integrator. The inverting input terminal (−) of the second operational amplifier OP_amp_2 may be continuously connected to the second data line DL2 by the second switch SW2. However, since the second pixel PX2 does not include a sensing transistor unlike the first pixel PX1, the feedback capacitor Cfb in the second measurement circuit 121*b* may be charged only with a voltage corresponding to a leakage current flowing through the second data line DL2. Accordingly, an electric potential (Vout_2) of the output terminal of the second operational amplifier OP_amp_2 may increase linearly from the reference voltage Vset according to the voltage corresponding to the leakage current in the second pixel PX2.

Referring to FIGS. 7 and 8, in the second measurement period Ssen_2, the first sensing signal SE1 may be inverted to a high level to turn off the sensing transistor MS_3. The feedback control signal fb may be maintained at a low level to continuously turn off the feedback switch SW_fb. The first and second control signals ϕ1 and ϕ2 may be maintained at a high level to continuously turn on the first and second switches SW1 and SW2. The first scan signal S1 may be maintained at a high level to continuously turn off the first and second switch transistors MS_1 and MS_2. The third control signal ϕ3 and the first and second initialization control signals Re1 and Re2 may maintain a low level to continuously turn off the third switch SW3 and the first and second initialization switches SW_RE1 and SW_RE2. In addition, a control signal SH that activates the CDS 121*c* may be inverted to a high level. Accordingly, the CDS 121*c* may perform correlated double sampling on output signals (Vout_1 and Vout_2) of the first and second measurement circuits 121*a* and 121*b*. For example, the CDS 121*c* may receive output signals having voltages stored in the output terminals of the first and second operational amplifiers OP_amp_1 and OP_amp_2 up until the sensing transistor MS_3 in each of the first pixels PX1 is turned off. Then, the CDS 121*c* may extract a potential difference between the output signals of the first and second operational amplifiers OP_amp_1 and OP_amp_2 and provide the extracted potential difference to the ADC 122*a* through the second multiplexer 122*b*. Here, the voltage stored in the output terminal of the first operational amplifier OP_amp_1 may be sampled as a first output voltage Vout_1, and the voltage stored in the output terminal of the second operational amplifier OP_amp_2 may be sampled as the second output voltage Vout_2. Then, the potential difference between the first and second output voltages Vout_1 and Vout_2 may be extracted. For example, the first output voltage Vout_1 may be expressed as the sum of a voltage corresponding to an electric current flowing through the organic light-emitting diode OLED in the first pixel PX1 and a voltage corresponding to a leakage current in the first pixel PX1, and the second output voltage Vout_2 may be expressed as a voltage corresponding to a leakage current in the second pixel PX2. According to an embodiment, since the voltage corresponding to the leakage current in the first pixel PX1 and the voltage corresponding to the leakage current in the second pixel PX2 are substantially the same, the potential difference between the first and second output voltages Vout_1 and Vout_2 can be expressed as the voltage corresponding to the electric current flowing through the organic light-emitting diode OLED in the first pixel PX1. Through this process, a leakage current component included in the first and second pixels PX1 and PX2 can be removed. Later, when a control signal ADC that activates the ADC 122*a* is inverted to a high level, the ADC 122*a* may convert an output signal of the CDS 121*c* into a digital signal ADC_OUT and provide the digital signal ADC_OUT to the timing controller 130 (see FIG. 1). The timing controller 130 (see FIG. 1) may receive the digital signal ADC_OUT from the ADC 122*a* and compensate the first and second data signals D1 and D2 using the digital signal ADC_OUT.

Referring back to FIG. 8, before the display period E, the third control signal ϕ3 may be inverted to a high level, thereby turning on the third switch SW3. Then, in the display period E, the first scan signal S1 may be inverted to a low level to turn on the first and second switch transistors MS_1 and MS_2. The voltage level applied to the first and second driving transistors MD_1 and MD_2 may be increased from the voltage level of the second power supply terminal ELVSS back to the original voltage level of the first power supply terminal ELVDD. To this end, in the display period E, the first and second power switches SW_P_1 and SW_P_2 may perform switching operations to connect the signal paths between the first electrodes of the first and second driving transistors MD_1 and MD_2 and the first power supply terminal ELVDD. Then, the organic light-emitting diodes OLED in the first and second pixels PX1 and PX2 may emit light according to the compensated first and second data signals D1 and D2.

Embodiments of the present invention provide at least one of the following features.

That is, it is possible to more accurately measure an electric current of each pixel using a simple structure. Accordingly, a difference in degradation between the pixels can be compensated for, thereby realizing more uniform image quality.

In addition, the accuracy of current measurement can be increased by improving a SNR through differential sensing and correlated double sampling.

While the invention has been particularly shown and described with reference to example embodiments thereof, it will be understood by those of ordinary skill in the art that various changes may be made therein without departing from the spirit and scope of the invention as defined by the following claims and their equivalents. The example embodiments should be considered in a descriptive sense only and not for purposes of limitation.

What is claimed is:

1. A light-emitting display comprising:

a display panel comprising a first pixel;

a first data line electrically connected to the first pixel;

a data driver electrically connected to the first data line;

wherein the first pixel comprises:

a first light-emitting diode;

a sensing transistor comprising a first electrode electrically connected to the first data line and a second electrode electrically connected to the first light-emitting diode of the first pixel, a first driving transistor comprising a first electrode electrically connected to a first power supply terminal and a second electrode electrically connected to the first light-emitting diode; and a first switch transistor comprising a first electrode electrically connected to the first data line and a second electrode electrically connected to a gate electrode of the first driving transistor, wherein the data driver is configured to apply a data signal to the gate electrode of the first driving transistor through the first data line during a display period, and wherein the data driver is configured to apply a reference voltage to the first light-emitting diode through the sensing transistor and to measure an electronic current flowing through the first light-emitting diode during a sensing period.

2. The light-emitting display of the claim 1, wherein the data driver is configured to measure the electric current flowing through the first light-emitting diode corresponding to the reference voltage during the sensing period.

3. The light-emitting display of the claim 2, wherein the first switch transistor is configured to turn on during the display period, and wherein the sensing transistor is configured to turn off to apply the data signal to the gate electrode of the first driving transistor during the display period.

4. The light-emitting display of the claim 2, wherein the sensing period comprises a reference voltage supplying period and a measurement period following the reference voltage supplying period, wherein the sensing transistor is configured to turn on to apply the reference voltage to the first light-emitting diode after the data driver charges the reference voltage to the first data line during the reference voltage supplying period, and wherein the data driver is configured to measure a voltage corresponding to a leakage current of the first pixel and a voltage corresponding to an electric current flowing through the first light-emitting diode according to the reference voltage during the measurement period.

5. The light-emitting display of the claim 4, wherein the first pixel further comprises a first capacitor connected between the second electrode of the first switch transistor and the first electrode of the first driving transistor, wherein the sensing period further comprises an initialization period before the reference voltage supplying period, wherein the data driver is configured to charge a first initialization voltage with the first data line during the initialization period, and wherein the first switch transistor is configured to turn on to charge the first capacitor with a second initialization voltage during the initialization period.

6. The light-emitting display of claim 5, wherein a level of the first initialization voltage is lower than a level of a threshold voltage of the first light-emitting diode of the first pixel, and wherein a level of the second initialization voltage is higher than a level of the reference voltage.

7. The light-emitting display of claim 2, wherein a level of the reference voltage is equal to or higher than a level of a threshold voltage of the first light-emitting diode of the first pixel.

8. The light-emitting display of claim 2, wherein the data driver comprises:

a first measurement circuit comprising a first operation amplifier which has a non-inverting terminal to receive the reference voltage and an inverting terminal electrically connected to the first pixel, and a data driving unit electrically connected to the display panel through the first data line.

9. The light-emitting display of claim 8, wherein the first measurement circuit comprises:

a first feedback capacitor electrically connected between the inverting terminal of the first operation amplifier and an output terminal of the first operation amplifier, and a first feedback switch electrically connected in parallel to the first feedback capacitor between the inverting terminal of the first operation amplifier and the output terminal of the first operation amplifier and a first switch electrically connected between the first pixel and the inverting terminal of the first operation amplifier.

10. The light-emitting display of claim 8, wherein the data driving unit comprises:

a plurality of digital-to-analog converters electrically connected to the display panel through the first data line, and a plurality of third switches connected between the plurality of digital-to-analog converters and the first data line.

11. The light-emitting display of claim 2, wherein the first pixel further comprises a first capacitor connected between the second electrode of the first switch transistor and the first electrode of the first driving transistor.

12. The light-emitting display of claim 11, further comprising:

a power providing unit electrically connected to the first power supply terminal through a power supply line, wherein the data driver further comprises a first initialization switch connected between the first data line and the power providing unit.

13. The light-emitting display of claim 12, wherein the first initialization switch is configured to turn on during a first initialization period, and wherein the power providing unit is configured to charge the first data line with a first initialization voltage through the first initialization switch during the first initialization period.

14. The light-emitting display of claim 12, wherein the data driver further comprises a second initialization switch connected between the first data line and the power providing unit.

15. The light-emitting display of claim 14, wherein the second initialization switch is configured to turn on during a second initialization period following a first initialization period, and wherein the power providing unit is configured to charge a second initialization voltage to the first capacitor through the second initialization switch during the second initialization period.

16. The light-emitting display of claim 2, further comprising:

a power switch configured to connect a power line connected to the first electrode of the first driving transistor to the first power supply terminal or a second power supply terminal having a lower electric potential than the first power supply terminal.

17. The light-emitting display of claim 16, wherein a cathode of the first light-emitting diode of the first pixel is electrically connected to the second power supply terminal.

18. The light-emitting display of claim 16, wherein the first electrode of the first driving transistor is configured to connect the first power supply terminal during the display period, and wherein the first electrode of the first driving transistor is configured to connect the second power supply terminal during the sensing period.

19. The light-emitting display of claim 2, further comprising:

a second pixel; and a second data line electrically connected to the second pixel and the data driver;

wherein the second pixel comprises:

a second light-emitting diode;

a second driving transistor comprising a first electrode electrically connected to a first power supply terminal and a second electrode electrically connected to a second light-emitting diode of the second pixel; and a second switch transistor comprising a first electrode electrically connected to the second data line and a second electrode electrically connected to a gate electrode of the second driving transistor, wherein the data driver is configured to apply a data signal to the gate electrode of the second driving transistor through the second data line during a display period.

20. The light-emitting display of claim 19, wherein the data driver comprises:

a first measurement circuit comprising a first operation amplifier having a non-inverting terminal to receive the reference voltage and an inverting terminal connected to the first pixel, and a second measurement circuit comprising a second operation amplifier having a non-inverting terminal to receive the reference voltage and an inverting terminal connected to the second pixel.

21. The light-emitting display of claim 20, wherein the data driver further comprises a correlated double sampler connected to each of the first and second operation amplifiers, and wherein the correlated double sampler is configured to calculate a potential difference between output signals of the first and second measurement circuits.

* * * * *